US005332011A

United States Patent [19]

Spalding

[11] Patent Number: 5,332,011

[45] **Date of Patent: * Jul. 26, 1994**

[54] GASOLINE DISPENSER WITH VAPOR RECOVERY SYSTEM

[75] Inventor: Robert G. Spalding, Salisbury, Md.

[73] Assignee: Dresser Industries, Inc., Dallas, Tex.

[ * ] Notice: The portion of the term of this patent subsequent to Mar. 23, 2010 has been disclaimed.

[21] Appl. No.: 1,787

[22] Filed: Jan. 8, 1993

Related U.S. Application Data

[63] Continuation of Ser. No. 693,549, Apr. 30, 1991, Pat. No. 5,195,564.

[51] Int. Cl.[5] ..... B65B 1/04

[52] U.S. Cl. ..... 141/59; 141/45; 141/83

[58] Field of Search ..... 141/1, 44–46, 141/59, 83, 192, 198

[56] References Cited

U.S. PATENT DOCUMENTS

| | | | |
|---|---|---|---|
| 3,826,291 | 7/1974 | Steffens | 141/59 |
| 3,881,894 | 5/1975 | Onufer | 55/58 |
| 3,913,633 | 10/1975 | Hiller | 141/45 |
| 4,047,548 | 9/1977 | Wagner | 141/59 |
| 4,056,131 | 11/1977 | Healy | 141/206 |
| 4,057,086 | 11/1977 | Healy | 141/206 |
| 4,058,147 | 11/1977 | Stary et al. | 141/45 |
| 4,068,687 | 1/1978 | Long | 141/59 |
| 4,095,626 | 1/1978 | Healy | 141/206 |
| 4,167,958 | 9/1979 | Voelz | 141/95 |
| 4,197,883 | 4/1980 | Mayer | 141/59 |
| 4,202,385 | 5/1980 | Voelz et al. | 141/59 |
| 4,253,503 | 3/1981 | Gunn | 141/59 |
| 4,260,000 | 4/1981 | McGahay et al. | 141/59 |
| 4,295,505 | 10/1981 | Hasselmann et al. | 141/59 |
| 4,310,033 | 1/1982 | Deters | 141/44 |
| 4,336,830 | 6/1982 | Healy | 141/59 |
| 4,429,725 | 2/1984 | Walker et al. | 141/59 |
| 4,687,033 | 8/1987 | Furrow et al. | 141/59 |
| 5,038,838 | 8/1991 | Bergamini et al. | 141/59 |
| 5,040,577 | 8/1991 | Pope | 141/59 |
| 5,156,199 | 10/1992 | Hartsell, Jr. et al. | 141/83 |
| 5,172,738 | 12/1992 | Komukai et al. | 141/83 |
| 5,195,564 | 3/1993 | Spalding | 141/1 |
| 5,197,523 | 3/1993 | Fink, Jr. et al. | 141/206 |

*Primary Examiner*—Ernest G. Cusick
*Attorney, Agent, or Firm*—L. Dan Tucker

[57] ABSTRACT

A service station dispenser for gasoline with a vapor collection system is disclosed which processes the electrical signal typically produced by the fuel meter which represents the volume flow rate of fuel to the tank to control the displacement volume of an electrically driven vacuum pump so that a simple vacuum intake disposed preferably inside, but not sealed with, the filter neck can be used to collect only the vapors displaced from the fuel tank by the fuel. The vacuum pump is preferably controlled by the same digital processor which calculates and displays volume and cost to the customer, and a single vacuum pump can be used in connection with single point of sale, multiple fuel grade systems or with multiple point of sale, single grade systems for enhanced economy of cost.

21 Claims, 4 Drawing Sheets

GASOLINE DISPENSER WITH VAPOR RECOVERY SYSTEM

This is a continuation application of U.S. Ser. No. 07/693,549, filed Apr. 30, 1991 now U.S. Pat. No. 5,195,564.

FIELD OF THE INVENTION

This invention relates generally to volatile liquid dispensing systems of the type used to dispense gasoline into automotive fuel tanks, and more particularly relates to such a dispensing system which includes a vapor collecting system.

BACKGROUND OF THE INVENTION

As an automobile is being refueled with gasoline at a service station, each gallon of gasoline flowing into the fuel tank displaces approximately three hundred cubic inches of gasoline vapor which, unless collected, escapes into the atmosphere. Such vapors not only contribute to atmospheric pollution, but also are unpleasant to the person operating the nozzle, and may adversely affect the person's health over a longer term. As a result, some governmental authorities require that these vapors be collected. Various systems have been proposed and used for collecting and returning these vapors to a storage vessel, typically the underground storage tank from which the gasoline is being dispensed. The vapors thus stored are then collected for subsequent disposal by the over-the-road tanker when it delivers additional fuel to the storage tank.

In one such system, the dispensing pump nozzle is sealed to the filler pipe of the fuel tank so that the displaced vapor is directed by way of an annular conduit around the nozzle and coaxial dual conduit hose and appropriate plumbing to the underground storage tank. The design of the nozzle necessary to effect a seal has generally involved the addition of a bellows around the spout to seal the annular vapor passageway to the filler neck of the tank, as well as various other modifications which make the hand-held nozzle heavy and cumbersome, thereby causing the fueling process to be quite difficult and onerous, particularly for the self-serve motorist.

The problems relating to the design of the nozzle has been mitigated to a large extent by a system which utilizes a vacuum pump to assist the collection of vapor and transfer it to the storage tank. As a result of the use of the vacuum pump, it is unnecessary to seal the vapor line to the filler neck of the tank by the bellows, hence reducing the weight of the nozzle and simplifying the fueling process. In this type system, the vacuum inlet for the vapors need only be placed in close proximity to the filler neck of the tank. However, it is very important in this system that the rate of gaseous mixtures drawn in through the vacuum inlet closely approximate the volume of vapor being displaced by the gasoline flowing into the tank. If the volume of vapor being collected is less than that flowed from the tank, it will obviously result in some vapor escaping into the atmosphere. On the other hand, if a volume greater than the displaced vapors is collected, either air may be drawn in with the vapors, which can create a hazardous vapor/air mixture in the storage tank, or a portion of the gasoline dispensed into the tank will be vaporized to make up the difference between the volumetric displacement of the vacuum pump and the vapor displaced by the gasoline added to the fuel tank.

The systems previously developed which utilized this system achieved the control of the appropriate ratio of vapor to liquid dispensed by driving a positive displacement vacuum pump with a hydraulic motor driven by the flow of gasoline being dispensed to the tank. A major disadvantage of this type system (hereinafter discussed in detail in connection with FIG. 2) is the requirement that there be a hydraulically-driven vacuum pump for each dispensing hose or nozzle; and each pump unit is relatively expensive to manufacture. In addition, the large number of individual nozzles associated with each typical multi-grade dispensing unit results not only in complex and expensive plumbing, but also occupies substantial space. Thus, the total cost of the system is a deterrent to its widespread adoption.

In another type system, a jet pump is driven by one of the submersible pumping units, for example, the regular grade, of the service station to generate a vacuum in a common vapor manifold. While this system does not eliminate the seal required at the nozzle, it does allow use of a less critical seal. The disadvantages of this type system are that whenever a dispenser for a premium grade is turned on, the regular grade submersible pump must be switched on regardless of whether the regular grade is selected or not by the customer. In addition to wasting power, this also tends to generate vapor at the regular grade pump unit. Further, the plumbing required is complex and subject to leaks, and a seal is still required at the nozzle sufficient to prevent air from being drawn into the system because the displacement of the jet pump is not related to the flow of gasoline at the dispensing point.

SUMMARY OF THE INVENTION

The present invention overcomes the disadvantages of the above systems in that it provides a system which eliminates the necessity of a seal between the vapor collection line and the filler neck of the fuel tank, yet provides an economical system for collecting only the correct volume of vapors for the amount of liquid being dispensed, and has progressively increasing economic advantage as the system becomes more complex, as is typical for multi-grade, multi-lane dispensing systems employed in modern self-service refueling facilities.

In accordance with the present invention, a volatile liquid such as gasoline is pumped from a storage tank through a flow meter and dispensed through an on-demand nozzle by the customer into the fuel tank of a vehicle. Vapors displaced from the tank are collected through a vacuum intake, preferably disposed concentrically with the nozzle and terminating near the end of the filler neck of the tank; and pumped by an electric motor driven vacuum pump to a vapor storage tank, preferably the fuel storage tank. The flow meter produces an electrical signal representative of the liquid volume flow rate which is used to control the volume of vapor pumped by the vacuum pump so that it is maintained at a preselected ratio with respect to the volume of liquid flowing into the fuel tank.

In accordance with another aspect of the invention, a single vacuum pump is manifolded to collect vapors from a plurality of dispensing nozzles. The nozzles can be part of a multi-grade, single point of sale system, or a combination of each by sizing the vacuum pump and controlling its volumetric rate dependent upon the total volume of liquid fuel being simultaneously dispensed from the nozzles.

DESCRIPTION OF THE DRAWINGS

These and other objects, features and advantages of the invention will be apparent to those skilled in the art from the following description of the preferred embodiment taken together with the accompanied drawings in which.

DESCRIPTION OF THE PRIOR ART

Figure 1:
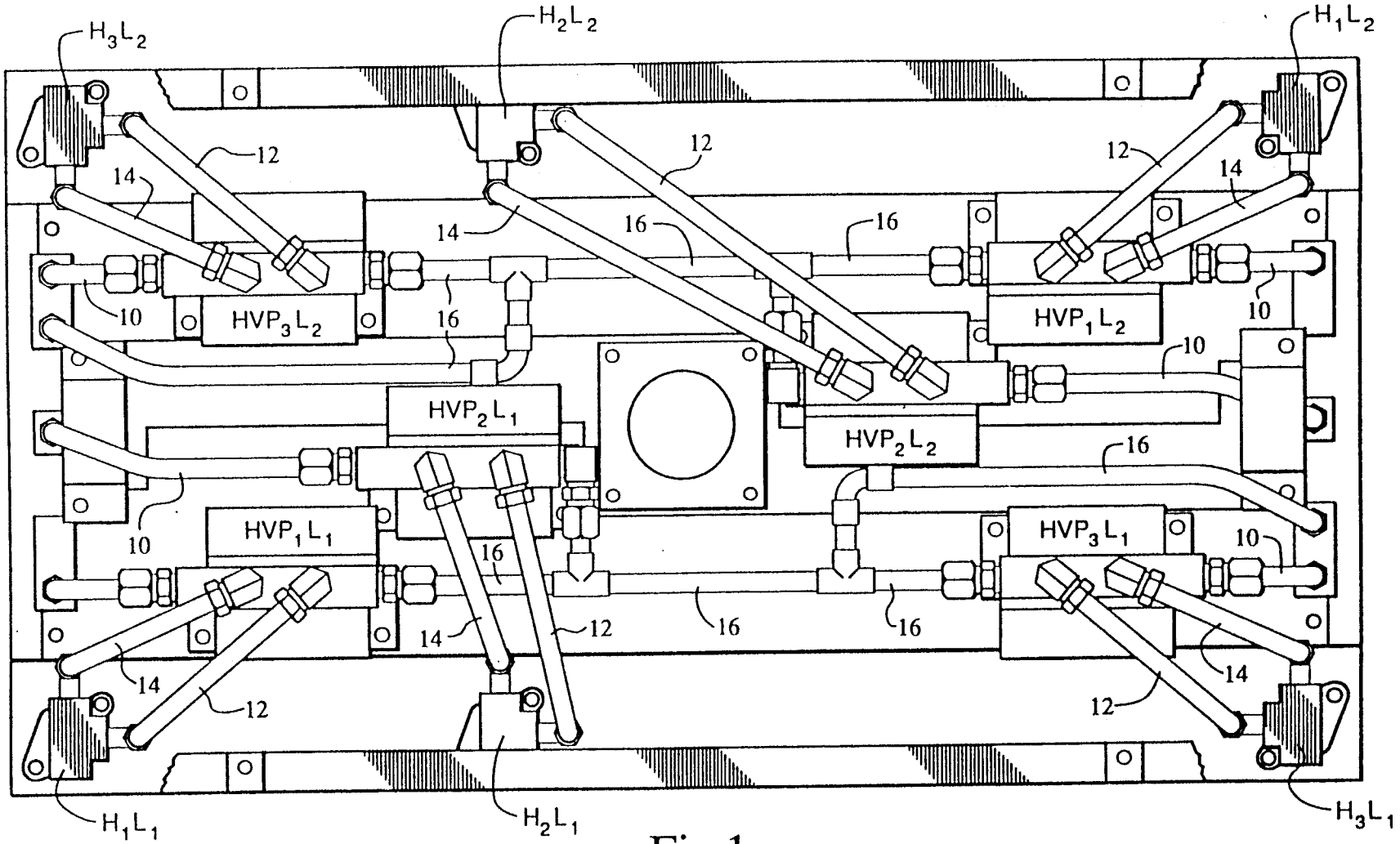
Fig.1 (PRIOR ART)
FIG. 1 is a plan view of the typical plumbing layout of a prior art liquid dispensing system.

A prior art system is disclosed in FIG. 1 which includes a liquid dispensing system of the type referred to above which utilizes hydraulically-driven vacuum pumps to collect vapor and described generally in U.S. Pat. No. 4,202,385. FIG. 1 illustrates the plumbing arrangement for such a system which is designed to dispense three grades of fuel from two points of sale, one in each of two traffic lanes. Thus, the three grades of gasoline would be dispensed through hoses and associated nozzles attached to hose headers $H_1L_1$, $H_2L_1$ and $H_3L_1$ to serve a customer's vehicle in lane one. Similarly, three hoses would be attached to hose headers $H_1L_2$, $H_2L_2$ and $H_3L_2$ to dispense three grades of fuel to a vehicle in lane two. Each hose (not illustrated in FIG. 1) includes a fuel delivery line and a vapor return line communicating with a hand-held nozzle which includes only a hand-operated fuel valve. Hydraulically-driven vapor pumps $HVP_1L_1$, $HVP_2L_1$ and $HVP_3L_1$ are provided for the respective hose headers $H_1L_1$, $H_2L_1$ and $H_3L_1$ of lane one. Fuel lines 12 extend from the respective vapor pumps to the respective hose headers and vapor return lines 14 interconnect the respective headers and vapor pumps. After passing through a flow meter, fuel under pressure is delivered to the respective hydraulic motors of the vapor pumps by lines 10, and the vapor is output from the vacuum pumps to a common vapor header 16, which returns vapor to the separate fuel storage tanks (not illustrated) for the three grades of fuel. The tanks are interconnected by a common vapor header in the conventional manner. Thus, it will be seen that for a dual lane, dual point of sale dispenser for three grades of fuel, a total of six hydraulically-driven vapor pumps HVP are required together with all of the associated plumbing illustrated. Each HVP pump collects a volume of gas (vapor) which is 1.3 times as great as the equivalent volume of liquid gasoline passing through the hydraulic motor complex to drive the vacuum pump.

DESCRIPTION OF A PREFERRED EMBODIMENT OF THE INVENTION

Figure 2:
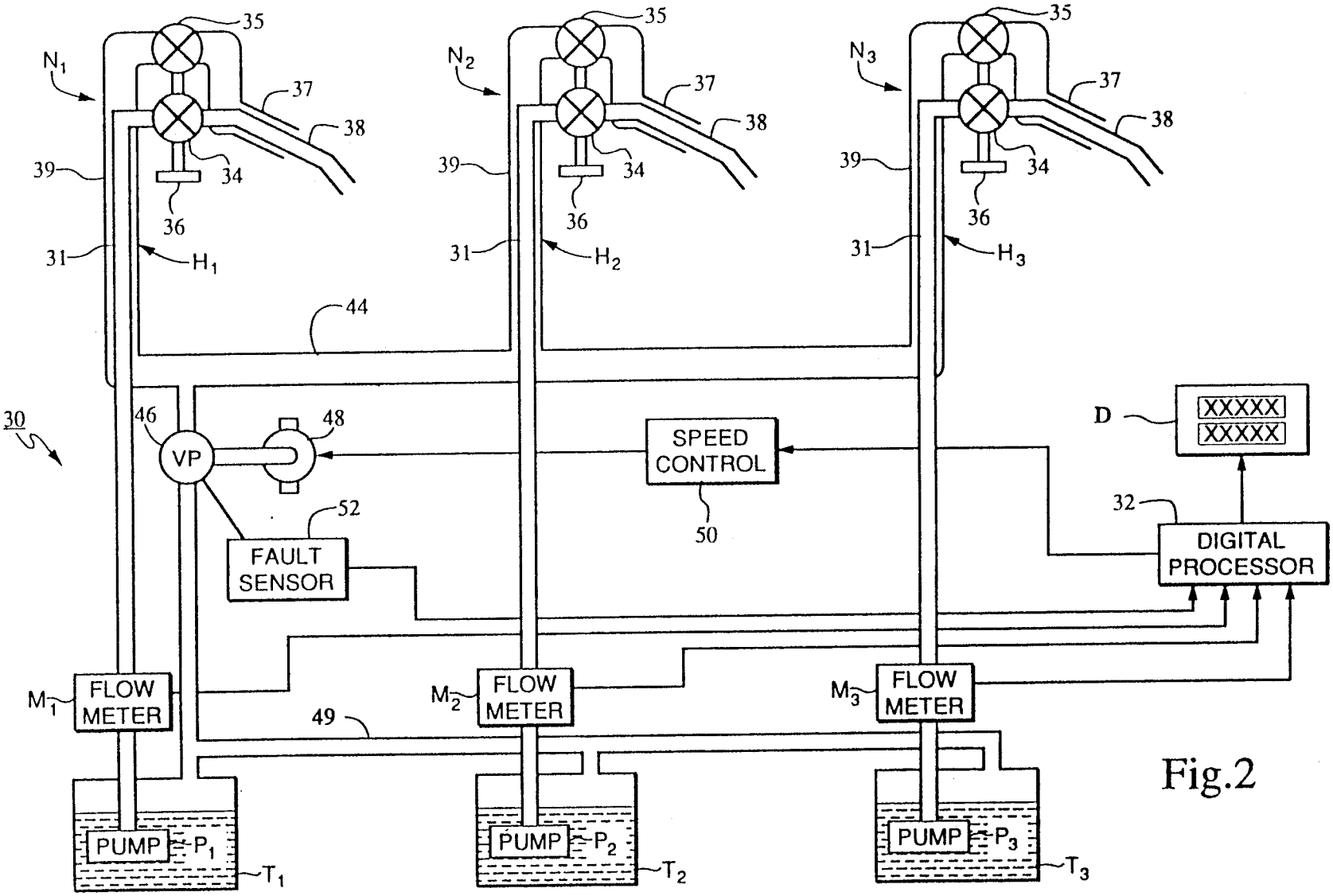
FIG. 2 is a schematic diagram which serves to illustrate a preferred embodiment of a liquid dispensing system in accordance with the present invention.

A liquid fuel dispensing system in accordance with the present invention is indicated generally by the reference numeral 30 in FIG. 2. The system 30 illustrates a single-point dispensing system for three different grades of fuel stored in tanks $T_1$, $T_2$ and $T_3$. A submersed pump $P_1$ delivers fuel from the tank $T_1$ through a flow meter $M_1$ and one conduit 31 of a dual-line flexible hose $H_1$ to a hand-held nozzle unit $N_1$. Similarly, fuel is delivered from tank $T_2$ by pump $P_2$ through flow meter $M_2$ and the fuel line 31 of dual conduit hose $H_2$ to nozzle $N_2$, and fuel is delivered from tank $T_3$ by pump $P_3$, through flow meter $M_3$, dual conduit hose $H_3$ and hand-held nozzle $N_3$.

Each of the flow meters, $M_1$, $M_2$ and $M_3$, produce an electrical signal indicative of the volume of liquid flowing through the meter to the respective nozzles, which signal is fed to a digital processor 32. The digital processor continually integrates the flow rate information to calculate the total volume and cost of the fuel as it is being dispensed through the meter activated by the customers use of the respective on-demand nozzle. This information is typically shown to the customer on a display D at the point of sale, and may also be displayed to the cashier in a self-service operation.

Each of the nozzles, $N_1$, $N_2$ and $N_3$, includes a fuel valve 34 and a vacuum valve 35 which are simultaneously operated by a hand actuated lever 36. A vacuum intake 37 is disposed adjacent a fuel outlet nozzle 38 so as to be partially within the filler neck of the tank, or in such other manner as to effectively capture the vapors displaced from the fuel tank as the gasoline flows into the tank. When the valves 34 and 35 are opened at the same time by the customer-actuated lever 36, the vacuum intake is opened to the vacuum return line 39 of the respective hose, $H_1$, $H_2$ or $H_3$, and thence to a common vacuum header 44, which in turn is connected to the intake of a positive displacement vacuum pump 46, which is preferably a conventional type pump. The output of the vacuum pump is connected to a vacuum header 48 interconnecting the fuel storage tanks $T_1$, $T_2$ and $T_3$.

The vacuum pump 46 is driven by a variable speed electric motor 49. Electrical power for the motor and other electrical components are not illustrated for simplicity. The speed of the motor 49 is controlled by a suitable speed control circuit 50 which, in turn, is controlled by an output from the digital processor 32. A fault sensor 52 detects a failure of operation of the vacuum pump and provides an appropriate signal to the digital processor 32 which disables the system from dispensing fuel in the event of a vacuum pump failure. The digital processor 32 can be a dedicated microprocessor, but in a preferred embodiment of the invention, is the processor which also operates the total service station system and includes the calculation of the volume being delivered to the customer and the cost, which information is displayed at the point of sale by display 33.

A typical delivery rate of fuel through a selected nozzle is about ten gallons per minute, thus requiring about three thousand cubic inches per minute displacement for the vacuum pump at a maximum speed of about 1,500 rpm. Such a pump typically requires a two-amp, 120 volt, 50/60 cycle electric motor with a speed range from zero to 1,500 rpm. Such a pump and motor can be manufactured at a relatively low cost. The speed control 50 is of conventional design, and is responsive to an appropriate signal produced by the digital processor 32 in response to the signal from the active flow meter $M_1$, $M_2$ or $M_3$, which typically provides pulses at a rate corresponding to the flow rate through the meter. The rate of these pulses can easily be translated into the appropriate signal to synchronize the pumping rate of the vacuum pump with the flow rate of the gasoline through the meter and maintain a predetermined vapor/gasoline ratio, preferably 1.3:1.0.

In the operation of the system 30 of FIG. 2, the pumps $P_1$, $P_2$ and $P_3$ provide liquid fuel under pressure to the respective nozzles $N_1$, $N_2$ and $N_3$. When a customer selects a grade of fuel and inserts the selected nozzle 38 in the neck of the tank, the vacuum intake 37 is disposed slightly within the filler neck of the tank. When the customer activates the nozzle lever, both the fuel valve 34 and vacuum valve 35 are opened and fuel flows into the customer's tank. Fuel flowing through the respective meter causes a signal to be sent to the digital processor 32 which causes the speed control to operate the electric motor at the appropriate rate to collect only the vapors displaced from the fuel tank. The vapors are returned to the fuel storage tanks to replace the liquid fuel being withdrawn.

Figure 3:
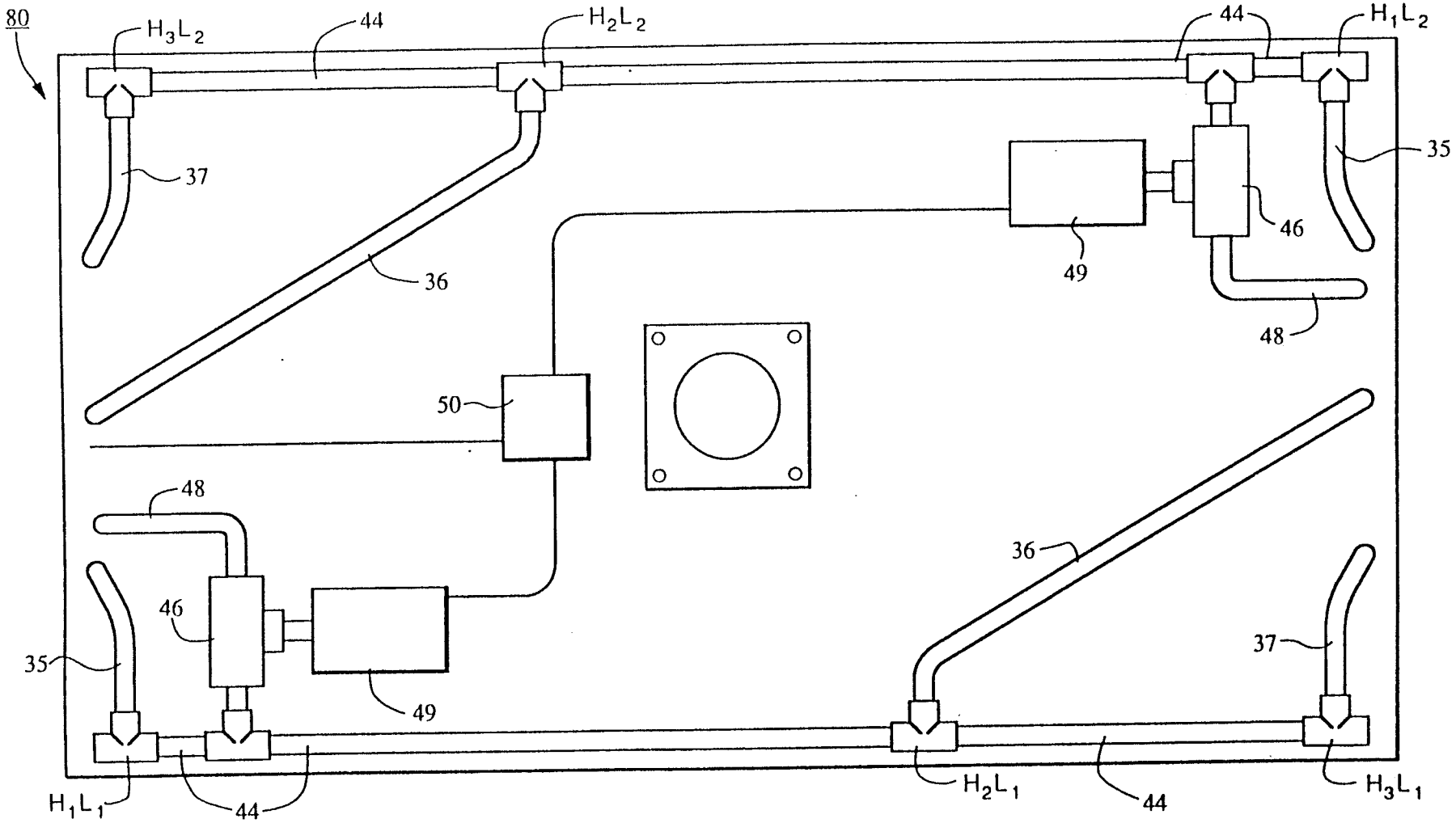
FIG. 3 is a plan view of a plumbing diagram illustrating the liquid dispensing system of FIG. 2 as compared to the prior art system of FIG. 1; and, FIG. 4 is a schematic diagram of an alternative liquid dispensing system in accordance with the present invention.

The advantages of the system of FIG. 2 compared to the prior art device of FIG. 1 are readily apparent from FIG. 3. FIG. 3 depicts the system of FIG. 2 designed to provide a two-lane unit, indicated generally by the reference numeral 80, capable of dispensing three grades from a single point of sale for each lane, which is the same type unit as disclosed as prior art in FIG. 1. Accordingly, the same reference characters are used for the corresponding components $H_1L_1$, $H_2L_1$, $H_3L_1$ and $H_1L_2$, $H_2L_2$ and $H_3L_2$. The hose manifolds $H_1L_1$, $H_2L_1$ and $H_3L_1$ are the swivel connections for the dual conduit hoses $H_1$, $H_2$ and $H_3$ for the system 30 of FIG. 2. The vapor manifold 44 collects the vapors from the three hoses and directs it to the intake of vacuum pump 46, the output of which is fed to the storage tank manifold 48. Fuel lines 40, 41, and 42 extend to the respective hoses $H_1$, $H_2$ and $H_3$ for lane one. The speed controller 50 controls the motor 49 which drives the vacuum pump. A duplicate set of parts to that just described is associated with hoses $H_1L_2$, $H_2L_2$ and $H_3L_2$ for service lane two and are designated by corresponding reference characters. From a comparison of FIGS. 1 and 3, it will be appreciated that the system of the present invention shown in FIG. 3 is substantially less complex and less expensive to fabricate than the prior art system shown in FIG. 1. The more complex the system, the greater the cost savings of the present invention.

Figure 4:
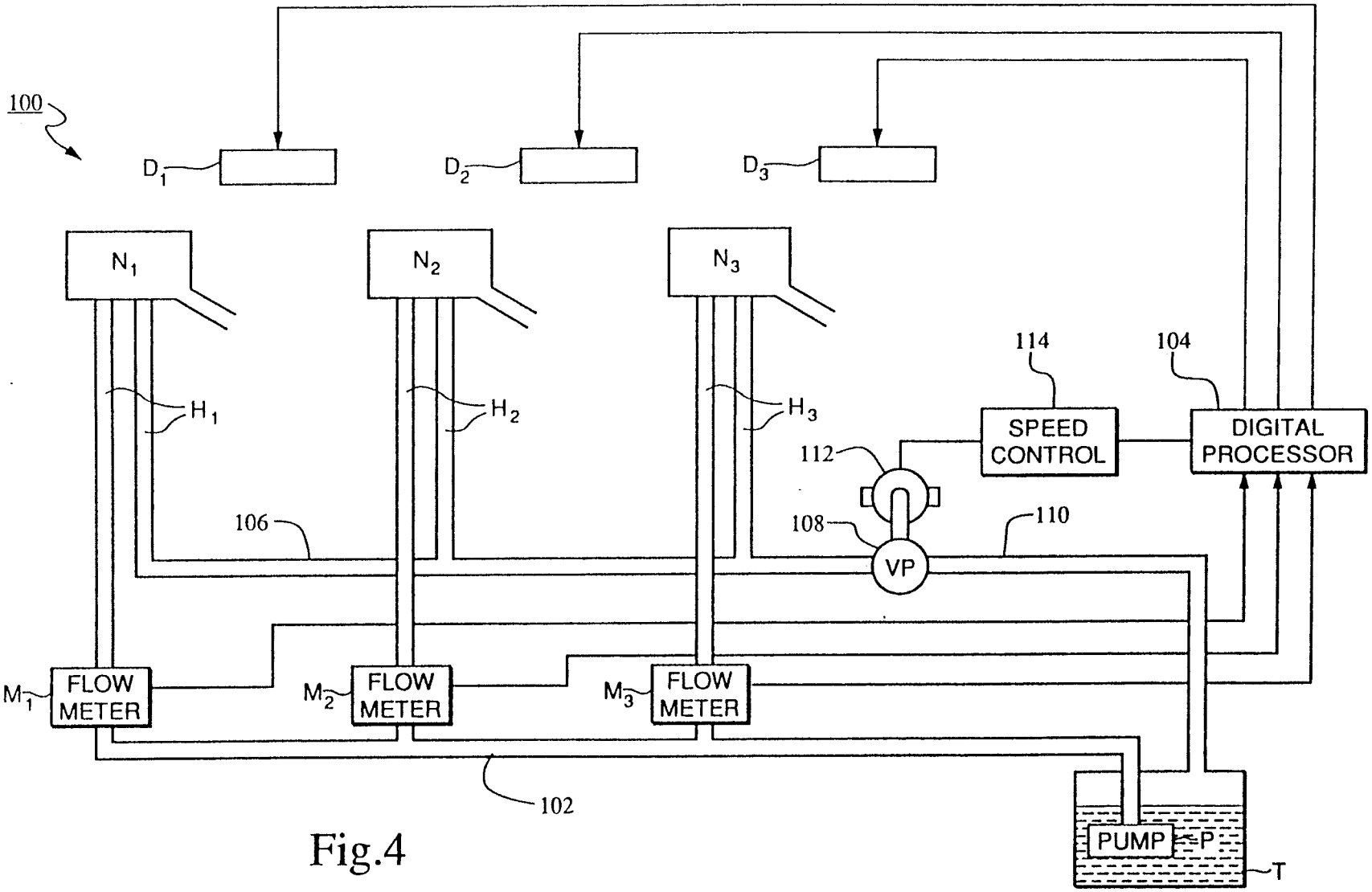

Another embodiment of the present invention is indicated generally by the reference number 100 in FIG. 4. This system is similar to the single point of sale, multiple grade system 30 of FIG. 2, but is designed to provide a plurality of points of sale of a single grade of fuel. Where applicable, the same reference characters are used to designate the same component parts. The system 100 includes a single fuel tank T having a submersed pump P which pressurizes a fuel manifold 102. The manifold 102 provides fuel to three flow meters $M_1$, $M_2$ and $M_3$ which measure the flow rate of fuel being fed through concentric, dual conduit, flexible hoses $H_1$, $H_2$ and $H_3$ to nozzles $N_1$, $N_2$ and $N_3$, each having both a fuel valve and vacuum valve, all of which may be substantially as heretofore described in connection with the system 30 of FIG. 2. However, the electrical signals representing volume flow rate information from the meters $M_1$, $M_2$ and $M_3$ are each fed to a digital processor 104 which, in turn, provides point of sale volume and cost information to displays $D_1$, $D_2$ and $D_3$ associated with the fuel dispensed through the respective nozzles $N_1$, $N_2$ and $N_3$. A vapor collection manifold 106 is connected to the intake of a vapor vacuum pump 108, the output of which is connected back to the storage tank T by conduit 110. The vapor pump is driven by an electric motor 112, the speed of which is controlled by speed controller 114.

The vapor collection system 100 is thus very similar to that illustrated in FIG. 2 except that the vapor pump 108 must have a capacity adequate to handle the total vapor collections from all of the nozzles $N_1$, $N_2$ and $N_3$ when fuel is being dispensed from all of the nozzles simultaneously. As a consequence, the digital processor 104 provides an output to the speed controller 114 which is the sun of the total flow rates through meters $M_1$, $M_2$ and $M_3$. Also, the manifold 106 is designed such that the resistance to vapor flow through the respective hoses $H_1$, $H_2$ and $H_3$ and manifold are essentially equal. Further, the manually-operated vapor control valves, and the respective fuel valves are metering valves so that vapor is metered in by partially open vapor valves in the same proportion as fuel is metered out by a partially open fuel valve. Thus, the vacuum pump 108 is operated at a capacity sufficient to provide a total vapor displacement volume appropriate for the total liquid volume being dispensed through all the nozzles. Operating the proportioning valves in the vapor lines in synchronism with the respective fuel valves result in the appropriate amount of vapor being withdrawn from each of the respective fuel tanks being filled. It will, of course, be appreciated that the system of FIG. 4 is applicable for one, or any number of dispensing nozzles.

It will be appreciated that the vacuum pump means 46 and 49 can alternatively be a constant speed electric motor with a variable volume vacuum pump responding to the electrical signal from the digital processor. It will also be appreciated that a dedicated digital processor, or other electrical system can be used to control the volume throughput of the vacuum pump in response to the measured liquid flow rate.

Although preferred embodiments of the invention have been described in detail, it is to be understood that various changes, substitutions and alterations can be made therein without departing from the spirit and scope of the invention as defined by the appended claims.

What is claimed is:

1. A dispensing system for dispensing volatile liquids such as hydrocarbon fuel for vehicles into a tank having a filler neck while collecting the vapors to reduce atmospheric pollution comprising:

at least one liquid dispensing means including a hand-held nozzle and liquid valve means disposed at the end of a flexible hose for flowing liquid into the fuel tank of a vehicle under the control of an operator operating the liquid valve;

vapor collection means including:

a vapor intake means manipulated with the hand-held nozzle so as to be positioned closely adjacent, but not sealed with, the fuel tank during delivery of fuel to the tank;

a normally closed vapor valve operable when liquid is flowing through the liquid valve of the nozzle; and vapor suction means including a vapor pump driven by an electrical motor and coupled to draw vapor through the vapor intake and the vapor valve and deliver the vapor to vapor storage means;

a flow meter for producing a first electrical signal representative of the rate of flow of liquid being dispensed from the nozzle; and digital processing means for receiving the first electrical signal and operating the electric motor at a controlled rate to draw vapors through the vapor intake at a volumetric rate slightly greater than the volumetric rate at which liquid is being flowed from the nozzle whereby substantially all fuel vapor displaced from the tank will be delivered to the vapor storage means while minimizing delivery of air to the vapor storage means.

2. The dispensing system of claim 1 wherein a different grade of hydrocarbon fuel is dispensed from each of a plurality of nozzle and liquid valve means, and the digital processing means includes a point of sale display indicating the volume and cost of the fuel dispensed.

3. The dispensing system of claim 1 wherein there are three grades of fuel dispensed from three nozzle and liquid valve means.

4. The dispensing system of claim 2 wherein each grade of hydrocarbon fuel is dispensed from a different storage tank, vapor within the storage tanks are in fluid communication, and the collected vapors are returned to the storage tanks.

5. The dispensing system of claim 1 wherein each hand-held nozzle and liquid valve means includes a vapor valve operated in synchronization with and in response to manual operation of the liquid valve means whereby only the vapor intake associated with the nozzle from which liquid is being dispensed will function to collect vapor.

6. A dispensing for dispensing volatile liquids such as hydrocarbon fuel for vehicles into a tank having a filler neck while collecting the vapors to reduce atmospheric pollution comprising:

fuel dispensing means including at least one hand-held nozzle for insertion in the filler neck of a tank and a manually operated valve for providing a variable volume flow rate of fuel into the tank;

means for providing an electrical signal indicative of the volumetric flow rate of said fuel delivery means;

vapor collection means having a controllable volumetric flow rate, said vapor collection means including vapor intake means attached to the hand-held nozzle and when the nozzle is inserted in the filler neck of the tank being positioned closely adjacent to, but not sealed with, the filler neck for drawing vapor displaced from the tank by delivery of fuel and for conveying it to a vapor receiving tank; and means responsive to said electrical signal for making the volumetric flow of said vapor collection means greater than the volumetric flow of said fuel dispensing means by a predetermined ratio.

7. The dispensing system of claim 6 wherein the fuel dispensing means further includes a hand operated liquid valve attached to the nozzle and the vapor collection means includes a vapor valve between the vapor intake means and the second end which is opened only when fuel is being delivered.

8. The fuel dispensing system of claim 7 wherein:

there are a plurality of fuel dispensing means each connected to deliver fuel of a different grade from a different storage tank through a different nozzle;

the vapor collection means includes a vapor intake means for each nozzle;

a vapor pump for sucking vapor through the vapor intake means, and a vapor valve disposed between each vapor intake means and the vapor pump, the respective vapor valve being open when fuel is delivered through the respective nozzle.

9. The fuel dispensing system of claim 8 wherein the means responsive to said electrical signal calculates the quantity and/or cost of fuel delivered from the electrical signal and displays the resulting data to the customer at the point of sale.

10. The fuel dispensing system of claim 9 wherein the fuel delivery means delivers a plurality of different grades of fuel from a plurality of fuel storage tanks.

11. The fuel dispensing system of claim 8 or 10 wherein there are three different grades of fuel.

12. The fuel dispensing system of claim 7 wherein each vapor valve is attached to the respective hand-held nozzle and is opened in response to the user causing fuel to be delivered through the nozzle.

13. A dispensing system for dispensing volatile liquids such as hydrocarbon fuel for vehicles into a tank having a filler neck while collecting the vapors to reduce atmospheric pollution comprising:

a fuel delivery hose including a hand-held nozzle for insertion in the filler neck of a tank;

means for providing an electrical signal indicative of the volumetric flow rate of the fuel delivery through the fuel delivery hose;

a vapor collection hose including a vapor intake connected to the hand-held nozzle and positioned closely adjacent, but not sealed with the tank to collect vapor displaced from the tank by fuel being delivered to the tank;

a vapor pump coupled to said vapor collection hose so as to be capable of withdrawing liquids through it; and control means responsive to said signal for controlling the vapor pump to produce a volumetric flow rate in said hose slightly greater than the volumetric flow rate of the fuel.

14. A dispensing system for dispensing volatile liquids such as hydrocarbon fuel for vehicles into a tank having a filler neck while collecting the vapors to reduce atmospheric pollution comprising:

a plurality of fuel delivery hoses each including a hand-held nozzle for insertion in the filler neck of a tank;

a pump for each of said delivery hoses for providing a flow of fuel of a different grade to the respective nozzle;

a vapor recovery hose including a vapor intake connected to each hand-held nozzle and positioned closely adjacent, but not sealed with the opening of the tank to collect vapor displaced from the tank by fuel being delivered to the tank;

a vapor pump connected to said recovery hoses so as to be capable of withdrawing a flow of fluid through each recovery hose;

a fluid valve between each vapor intake and the vapor pump for permitting flow of fluid through the recovery hose only when liquid is being delivered through the respective fuel delivery hose;

signaling means for providing an electrical signal indicative of the volumetric flow in each of the fuel delivery hoses; and control means responsive to the electrical signals for controlling the vapor pump in such a manner as to produce a volumetric flow in the respective vapor hose slightly greater than that in the respective fuel delivery hose.

15. The fuel dispensing system of claim 14 wherein the control means includes means for indicating the volume and cost of the fuel dispensed at the point of sale.

16. A dispensing system for dispensing volatile liquids such as hydrocarbon fuel for vehicles into a tank having a filler neck while collecting the vapors to reduce atmospheric pollution comprising:

a fuel delivery hose including a hand-held fuel valve and nozzle for insertion in the opening of the tank;

a means for delivering fuel under pressure to the fuel delivery hose;

means for providing electrical pulses corresponding to the volumetric flow of liquid through said fuel delivery hose when the fuel valve is open;

a vapor recovery hose including a vapor intake connected to the hand-held nozzle for insertion in the opening of the tank without sealing with the tank;

a motor driven vapor pump for producing a volumetric flow through the vapor recovery hose corresponding to a signal applied to said motor; and a digital processing means, for producing the signal applied to the motor in response to the electrical pulses to produce a volumetric flow of vapor slightly greater than the volumetric flow of fuel to the tank.

17. A dispensing system for dispensing volatile liquids such as hydrocarbon fuel for vehicles into a tank having a filler neck while collecting the vapors to reduce atmospheric pollution comprising:

a plurality of liquid delivery means each including a liquid delivery hose including a hand-held nozzle for insertion in the opening of the tank;

metering means for the liquid delivery hose for providing pulses occurring at a repetition rate corresponding to the volumetric flow of liquid through said liquid delivery hose;

a vapor suction hose including a vapor intake connected to each hand-held nozzle for insertion in the opening of the tank without sealing with the tank;

a vapor valve for each vapor suction hose for permitting flow of vapor through the respective suction hose only when liquid is delivered through the respective delivery hose;

a motor driven vapor suction pump, said suction pump producing a volumetric flow through a suction hose having an open valve corresponding to a signal applied to said motor; and a digital processing means responsive to the pulses from the metering means for producing the signal applied to said motor to cause said suction pump to have a volumetric flow greater than the volumetric flow through the liquid delivery hose by a predetermined factor.

18. The dispensing system of claim 17 wherein the digital processing means includes means for computing the volume and cost of the fuel dispensed.

19. A dispensing system for dispensing volatile liquids such as hydrocarbon fuel for vehicles into a tank having a filler neck while collecting the vapors to reduce atmospheric pollution comprising:

a liquid fuel dispensing means including a hand-held unit with a fuel valve and a nozzle insertable in the filler neck of a fuel tank;

means for metering the flow rate of the liquid fuel being dispensed and producing an electrical signal representing the liquid fuel flow rate;

vapor collection means including a vapor hose having a vapor intake attached to the hand-held unit and insertable within but not sealable with the filler neck of the fuel tank and a variable speed suction pump to draw fluid through said vapor intake and hose; and digital processing means for operating said variable speed suction pump to maintain the rate of fluid pumped to be greater than the liquid fuel flow rate by a predetermined factor.

20. A dispensing system for dispensing volatile liquids such as hydrocarbon fuel for vehicles into a tank having a filler neck while collecting the vapors to reduce atmospheric pollution comprising:

liquid fuel delivery means for delivering a plurality of grades of fuel from a plurality of storage tanks including a nozzle insertable in the filler neck of a fuel tank and means for monitoring the flow rate of the liquid fuel being delivered and outputting an electrical signal indicative of the liquid flow rate, a vapor collection apparatus including a vapor hose having a vapor intake attached to the nozzle and insertable within but not sealable with the filler neck of the fuel tank and a variable speed vapor suction pump for pumping vapor through said vapor intake and hose; and digital processing means for operating the vapor suction pump at a controlled rate to collect a predetermined greater volume of vapor than volume of liquid fuel dispensed.

21. The vapor recovery fuel dispenser of claim 20 wherein the digital processing means computes the volume and cost of the fuel delivered from the electrical signal.

* * * * *